US012338559B2

(12) United States Patent
Wiles et al.

(10) Patent No.: US 12,338,559 B2
(45) Date of Patent: Jun. 24, 2025

(54) FIRE RESISTANT DOUBLE-KNIT FABRIC

(71) Applicant: MMI-IPCO, LLC, Spartanburg, SC (US)

(72) Inventors: Thomas C. Wiles, Easley, SC (US); Mark Eric Price, Mill Spring, NC (US); Kujtim Hoxha, Swampscott, MA (US)

(73) Assignee: Milliken & Company, Spartanburg, SC (US)

( * ) Notice: Subject to any disclaimer, the term of this patent is extended or adjusted under 35 U.S.C. 154(b) by 0 days.

(21) Appl. No.: 18/766,839

(22) Filed: Jul. 9, 2024

(65) Prior Publication Data

US 2025/0027236 A1 Jan. 23, 2025

Related U.S. Application Data

(60) Provisional application No. 63/527,969, filed on Jul. 20, 2023.

(51) Int. Cl.
*D04B 1/24* (2006.01)
*A41D 31/08* (2019.01)
(Continued)

(52) U.S. Cl.
CPC ..... *D04B 1/24* (2013.01); *A41D 31/085* (2019.02); *D04B 1/16* (2013.01); *D04B 1/18* (2013.01);
(Continued)

(58) Field of Classification Search
CPC ... D04B 1/24; D04B 1/22; D04B 1/14; D04B 1/16; D04B 1/18; D04B 21/14;
(Continued)

(56) References Cited

U.S. PATENT DOCUMENTS 2,401,830 A 6/1946 Kahil
2,921,456 A 1/1960 Evans
(Continued)

FOREIGN PATENT DOCUMENTS

AT 362042 4/1981
CN 1276291 12/2000
(Continued)

OTHER PUBLICATIONS

International Search Report and Written Opinion issued in App. No. PCT/US2022/051196, mailing date May 15, 2023, 27 pages.
(Continued)

*Primary Examiner* — Danny Worrell
(74) *Attorney, Agent, or Firm* — Cheryl J. Brickey

(57) ABSTRACT

A double-knit fabric containing a first knit layer, a second knit layer, and a plurality of stuffer yarns. The first knit layer contains a plurality of first yarns and forms the upper surface of the double-knit fabric. The second knit layer contains a plurality of second yarns and forms the lower surface of the double-knit fabric. The plurality of stuffer yarns is located between the first knit layer and the second knit layer. The double-knit fabric contains a plurality of anchored lines and a plurality of detached regions. The double-knit fabric the first knit layer has an undulating surface in at least 90% by number of the detached regions defined as the upper surface containing at least 3 inflection points in the warp or weft directions.

20 Claims, 5 Drawing Sheets

(51) Int. Cl.

| | |
|---|---|
| ***D04B 1/16*** | (2006.01) |
| ***D04B 1/18*** | (2006.01) |
| ***D04B 21/16*** | (2006.01) |
| ***D04B 21/18*** | (2006.01) |

(52) U.S. Cl.
CPC ..... *D04B 21/16* (2013.01); *D04B 21/18* (2013.01); *D10B 2331/021* (2013.01); *D10B 2501/04* (2013.01)

(58) Field of Classification Search
CPC ..... D04B 21/16; D04B 21/18; A41D 31/08; A41D 31/085; D10B 2331/021; D10B 2501/04
See application file for complete search history.

(56) References Cited

U.S. PATENT DOCUMENTS

| | | | | |
|---|---|---|---|---|
| 4,199,633 | A * | 4/1980 | Blore | D06C 11/00 28/162 |
| 5,569,233 | A | 10/1996 | Goulait | |
| 5,787,503 | A | 8/1998 | Murphy, III | |
| 6,156,406 | A | 12/2000 | Rock | |
| 6,277,469 | B1 | 8/2001 | Wildeman | |
| 6,779,368 | B2 | 8/2004 | Rock | |
| 6,828,003 | B2 | 12/2004 | Rock | |
| 7,217,456 | B1 | 5/2007 | Rock | |
| 7,380,421 | B1 | 6/2008 | Liu | |
| 7,579,045 | B2 | 8/2009 | Rock | |
| RE41,574 | E | 8/2010 | Rock | |
| 7,776,421 | B2 | 8/2010 | Rock | |
| 7,829,172 | B2 | 11/2010 | Rock | |
| 8,129,296 | B2 | 3/2012 | Rock | |
| 8,298,645 | B2 | 10/2012 | Rock | |
| 10,130,129 | B2 | 11/2018 | Rock | |
| 2003/0096548 | A1 | 5/2003 | Groitzsch | |
| 2005/0287894 | A1 | 12/2005 | Burns | |
| 2009/0019614 | A1 * | 1/2009 | Hagihara | D02G 3/443 2/167 |
| 2011/0117353 | A1 | 5/2011 | Henshaw | |
| 2011/0177294 | A1 * | 7/2011 | Rock | B32B 3/28 428/166 |
| 2012/0260422 | A1 | 10/2012 | Rock | |
| 2014/0087104 | A1 | 3/2014 | Kierderle | |
| 2015/0104604 | A1 | 4/2015 | Rock | |
| 2018/0179678 | A1 | 6/2018 | Dorton | |
| 2018/0236748 | A1 | 8/2018 | Rock | |
| 2019/0078241 | A1 | 3/2019 | Rose | |
| 2022/0097340 | A1 * | 3/2022 | Rock | B32B 25/14 |
| 2022/0282409 | A1 | 9/2022 | Hendry | |
| 2025/0027236 | A1 * | 1/2025 | Wiles | A41D 31/085 |

FOREIGN PATENT DOCUMENTS

| | | | |
|---|---|---|---|
| DE | 102014006212 | A1 | 12/2014 |
| DE | 102016102792 | | 8/2017 |
| EP | 0195355 | | 9/1986 |
| EP | 2354282 | | 8/2011 |
| EP | 3480350 | A1 | 5/2019 |
| GB | 1577399 | A | 10/1980 |
| JP | 2002371449 | A | 12/2002 |
| JP | 2003013346 | A | 1/2003 |
| JP | 2015030944 | A | 2/2015 |
| WO | 2021035563 | A1 | 3/2021 |
| WO | 2023121834 | A1 | 6/2023 |

OTHER PUBLICATIONS

International Search Report and Written Opinion issued in App. No. PCT/US2023/010925, mailing date May 15, 2023, 13 pages.
International Search Report and Written Opinion; PCT/US18/50890; Nov. 21, 2018; 22 pages.
International Search Report and Written Opinion issued in App. No. PCT/US2024/37612, dated Oct. 14, 2024, 14 pages.

* cited by examiner

FIRE RESISTANT DOUBLE-KNIT FABRIC

RELATED APPLICATIONS

This application claims priority to U.S. Provisional Patent Application 63/527,969 filed on Jul. 20, 2023 which is herein incorporated by reference in its entirety.

TECHNICAL FIELD OF THE INVENTION

The present invention is directed double-knit fabrics, more particularly to double-knit fabrics for garments.

BACKGROUND

Performance fabrics manufactured for use in insulating garments often include fleece fabric, i.e. fabric having a raised or brushed fiber surface for improved insulation performance. The surface of such fabrics is often formed of fleece, which is raised, i.e., given relatively higher loft, by mechanical brushing. It has, however, been recognized that the brushing process can often result in broken fibers, which, over time, can work loose, potentially resulting in microfiber pollution. Loss of fibers, e.g., during washing, can also result in deterioration of insulation performance. Further, it is recognized that broken fibers released during washing can get into wastewater, causing pollution. It is desirable to have a low fiber loss, low weight, and high insulative fabric for use in outerwear and other garment uses.

BRIEF SUMMARY OF THE INVENTION

A double-knit fabric having an upper surface and a lower surface and having a warp and weft direction. The weft direction is perpendicular to the warp direction. The double-knit fabric contains a first knit layer, a second knit layer, and a plurality of stuffer yarns. The first knit layer contains a plurality of first yarns and forms the upper surface of the double-knit fabric. The second knit layer contains a plurality of second yarns and forms the lower surface of the double-knit fabric. The plurality of stuffer yarns is located between the first knit layer and the second knit layer.

The double-knit fabric contains a plurality of anchored lines and a plurality of detached regions. The plurality of detached regions are bounded by the anchored lines. In the anchored lines, the first yarns from the first fabric layer and the second yarns from the second fabric layer are knitted together and in the detached regions the first fabric layer and second fabric layer are unattached.

The first knit layer and the second knit layer are integrated within the anchored lines at least one method selected from the method of interlacing first yarns of the first knit layer among the second yarns of the second knit layer, interlacing the second yarns of the second layer among the first yarns of the first knit layer, and interlacing a plurality of third yarns among the first yarns of the first knit layer and the second yarns of the second knit layer.

The plurality of anchored lines is in both the warp and weft directions and the anchored lines in the warp direction cross over the anchored lines in the weft direction. The double-knit fabric the first knit layer has an undulating surface in at least 90% by number of the detached regions defined as the upper surface containing at least 3 inflection points in the warp or weft directions. An inflection point is the point at which the surface switches from either concave to convex or convex to concave.

DETAILED DESCRIPTION

Figure 1:
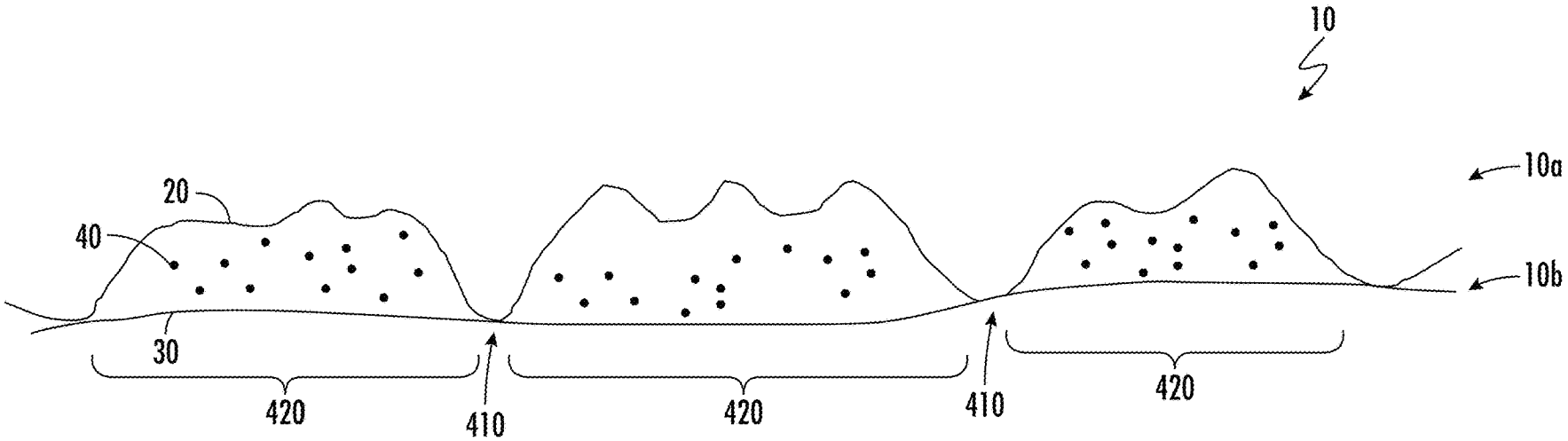
FIG. 1 is an illustration of a cross-section of the double-knit fabric according to one embodiment of the invention.

Referring now to FIG. 1, the double-knit fabric 10 of the invention has an upper surface 10*a* and a lower surface 10*b*, a warp direction and a weft direction (where the weft direction is perpendicular to the warp direction), and contains a first knit layer 20, a second knit layer 30, and a plurality of stuffer yarns 40. The first knit layer 20 forms the upper surface 10*a* of the double-knit fabric 10, the second knit layer 30 forms the lower surface 10*b* of the double-knit fabric 10, and the stuffer yarns 40 are located between the first 20 and the second 30 knit layers. The illustration of FIG. 1 is a cross-section along the weft direction such that the lines extending from left to right are the warp yarns and the dots are showing the stuffer yarns going into the page.

The detached regions 420 are interspersed between the anchored lines 410. In the anchored lines 410, the first fabric layer 20 and the second fabric layer 30 are knitted together forming a single unitary knit layer and in the detached regions 420 the first fabric layer 20 and second fabric layer 30 are unattached and are separate knit layers. This knitting of the first knit layer and the second knit layer is preferably done at the same time on the same knitting machine as knitting the first knit layer and the second knit layer. This is contrasted to a quilted fabric where the two layers are formed separately and then stitched together.

The stuffer yarns 40 are bulky yarns (shown going into the plane of the illustration) fill out the detached region 420 and give them their bumpy, undulating appearance. The detached regions may have any suitable shape, including, but not limited to squares, rectangles, ovals, octagons, hexagons, irregular amoeba-like shapes, jellybeans, diamonds, parallel channels, and elongated lines. Preferably, the detached regions are in a regular, repeating grid pattern which does include a horizontal/vertical grid, offset gird, brick pattern grid, and more.

The detached regions 420 and attached regions 410 may form varying amounts of the surface area of the upper surface 10*a* of the double-knit fabric 10 depending on the end use. Because the detached regions 420 tend to be more insulating, it is preferable to increase the amount of surface area of the detached regions 420 relative to the surface area of the upper surface 10*a* of the double-knit fabric 10. In one preferred embodiment, the detached region 420 form between about 60 and 99% of the surface area of the upper surface of the double-knit fabric, more preferably between about 75 and 98%, more preferably between about 85 and 96%.

Figure 3A:
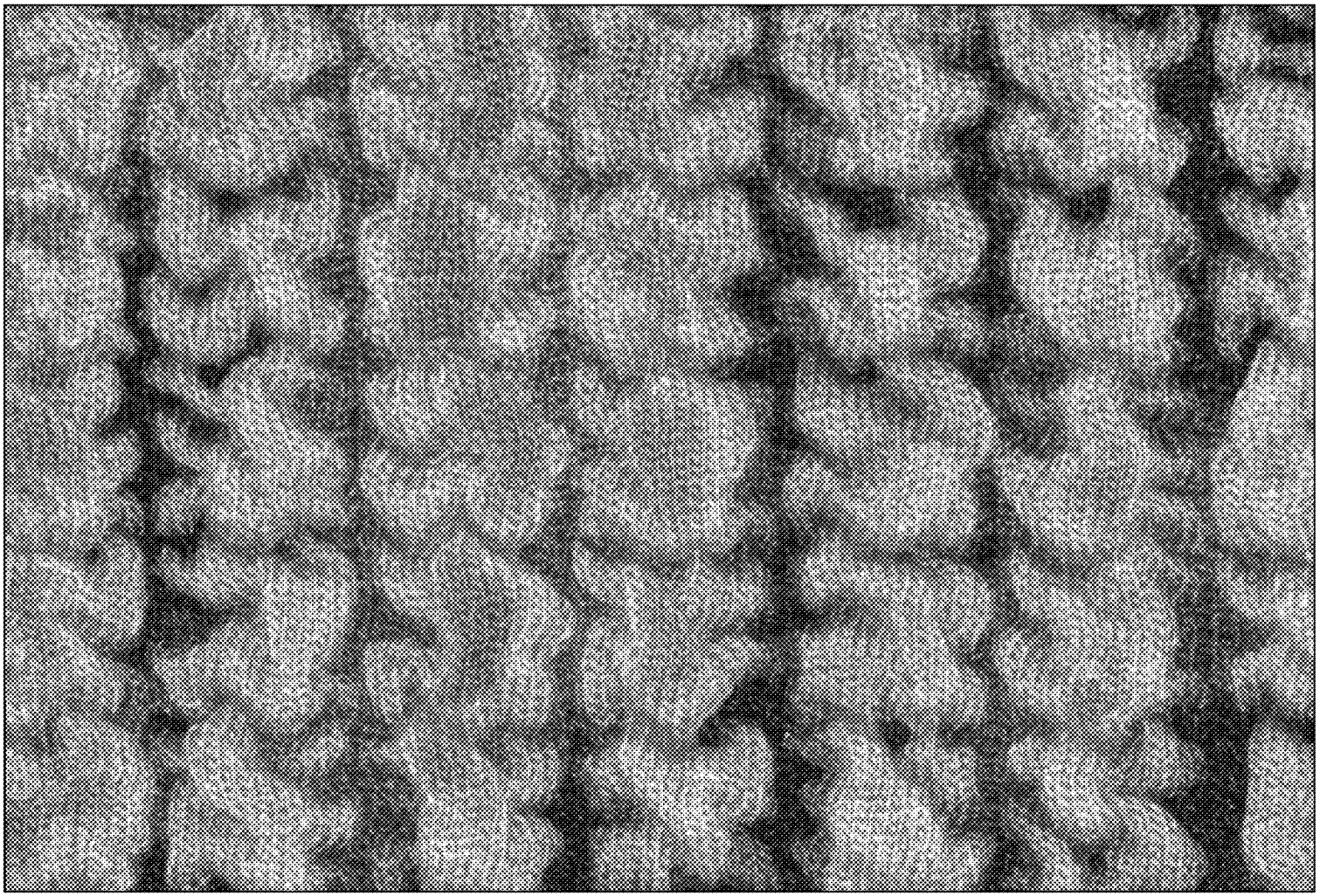
FIG. 3A photograph of the double-knit fabric according to one embodiment of the invention.
Figure 3B:
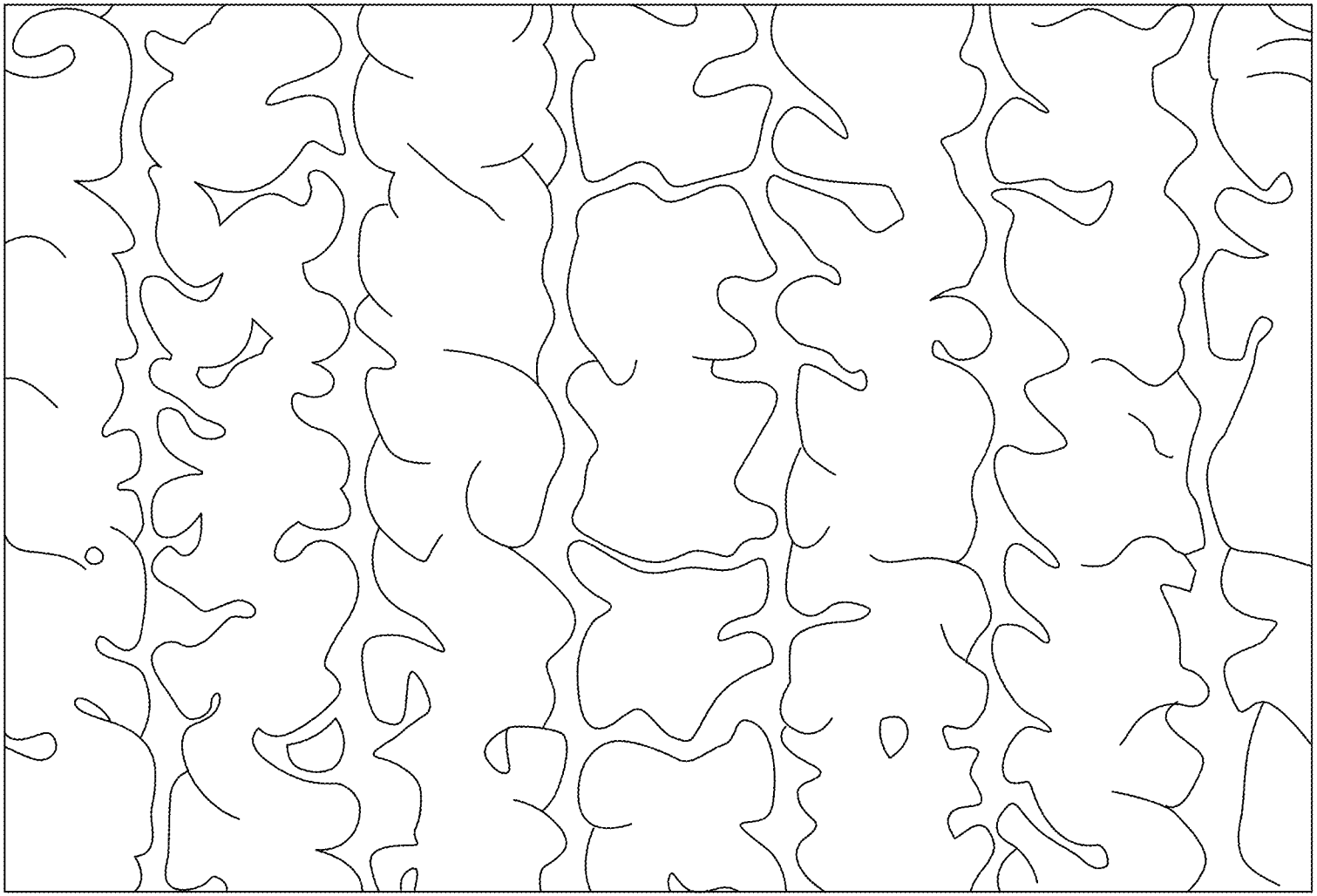
FIG. 3B is illustration of the photograph of FIG. 3A.

In FIG. 3A, there is shown a photograph of the upper surface 10*a* of the double-knit fabric 10 which shows the surface of the first knit layer 20. In this picture, one can see the detached regions (square-like shapes) on the fabric surrounded by a grid of attached regions and how the almost every detached region has an undulating surface. FIG. 3B is an illustration of FIG. 3A.

Preferably, the double-knit fabric has between about 2 to 10 detached regions per square inch, more preferably between about 2 to 5 detached regions per square inch. It has been found that this range of regions per square inch produces an insulative fabric that has good weight, thickness, and aesthetics. In one embodiment, the detached regions 420 preferably have at least one dimension in the plane of the double-knit fabric 10 of at least about 1 mm, more preferably at least about 3 mm, more preferably at least about 5 mm. Each of the detached regions 420 contain a plurality of knit stitches.

Each of the anchored lines 410 contain at least one knit stitch but may contain two knit stitches or more in at least one of the warp and weft depending on how wide the anchored lines are desired to be in the finished product. In one embodiment, the anchored lines 410 have a width of at least about 0.5 mm in both the warp and weft directions, more preferably at least about 1.0 mm in both the warp and weft directions. Preferably, the anchored lines are straight lines (approximately straight as fabric naturally shifts a little especially after wearing and/or washing). Straight lines during the manufacture of the fabric are easier to knot and manufacture. In another embodiment, the anchored lines are straight but have intentional curvature that is knitted. These curved anchor lines can give alternative looks to the finished fabric and garment.

Preferably, the anchored lines in the warp directions are all parallel (approx. parallel due to the shifting nature of fabric after manufacture) and have an average distance between them of between about 0.1 and 2 inches, more preferably between about 0.1 and 0.75 inches, more preferably between about 0.125 and 0.375 inch. In another embodiment, the anchored lines in the weft directions are all parallel and have an average distance between them of between about 0.1 and 3 inches, more preferably between about 0.1 and 1.5 inches, more preferably between about 0.125 to 0.75 inch. In another embodiment, the anchored lines in the warp and weft directions are parallel. These parallel lines in the warp and weft may cross over each other to form a regular, repeating grid and forms rectangular shaped detached regions between them. In another embodiment, the cross-over lines do not cross at perpendicular intersections, but at an angle forming diamond shaped regions. In another embodiment, the anchored lines are in only the warp or weft directions forming a series of rows or columns of detached regions.

How tall or high the detached regions 420 are also contributes to the insulative value and look to the fabric. In one embodiment, the average peak distance between the first fabric layer and the second fabric layer in the detached regions is at least about 3 mm. The average peak distance is calculated by measuring the distance between the inner surfaces (the surfaces facing each other) of the first knit layer and the second knit layer (note that this distance is between the two inner surfaces, this is not the total thickness of the fabric). This distance is measured on at least 10 different detached regions and then the result is averaged. In another embodiment, the average peak distance between the first fabric layer and the second fabric layer in the detached regions is at least about 3.5 mm, more preferably at least about 4.0 mm.

Figure 2:
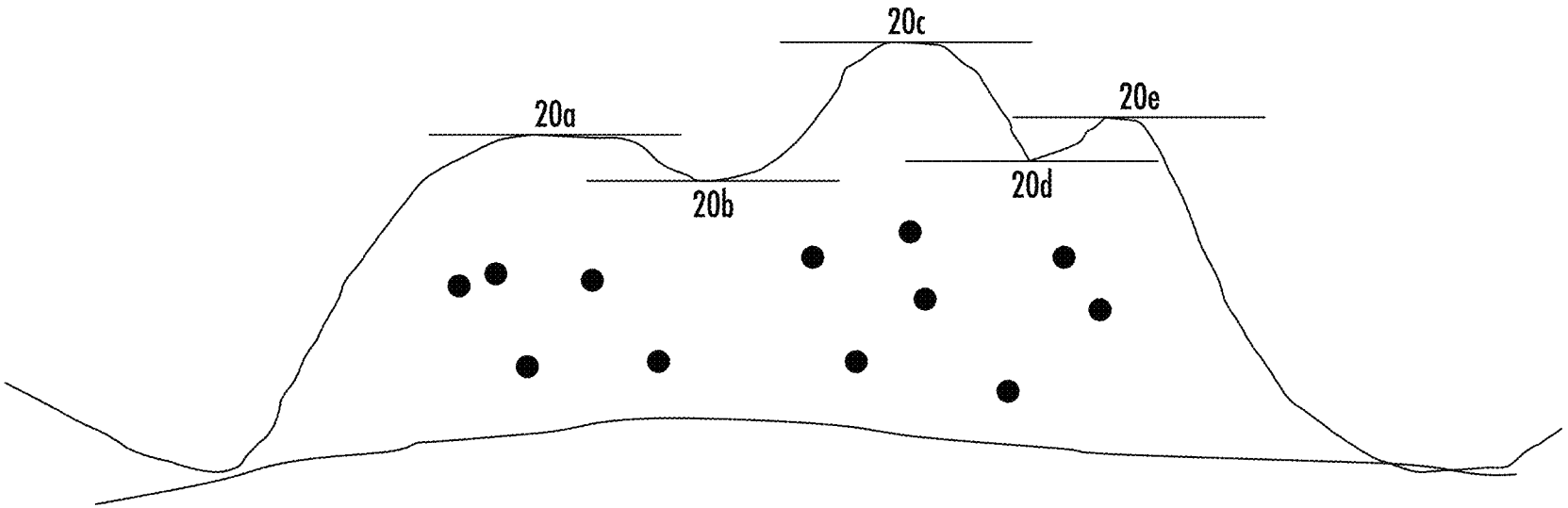
FIG. 2 is an enlargement of the illustration of FIG. 1 showing the inflection points.

The first knit layer (which forms the upper surface of the double-knit fabric) has an undulating surface in at least 90% by number of the detached regions defined as the upper surface containing at least 3 inflection points in the warp or weft directions. An inflection point is the point at which the surface switches from either concave to convex or convex to concave. Other double knit fabrics have a bubble like appearance that have a simpler bubble-like curve to the upper surface resulting in a single inflection point. On the other hand, the fabric of the invention has a very undulating surface which can be seen in FIGS. 3A and 3B where the fabric looks wrinkled and raison-like. In one embodiment, the first knit layer has an undulating surface in at least 90% by number of the detached regions in the warp direction. In another embodiment, the first knit layer has an undulating surface in at least 90% by number of the detached regions in the weft direction. In another embodiment, the double-knit fabric the first knit layer has an undulating surface in at least 30% by number of the detached regions defined as the upper surface containing at least 4 inflection points. FIG. 2 is a cross-sectional diagram of one detached region. In this example, there are 5 inflection points, 20*a*, 20*b*, 20*c*, 20*d*, and 20*e*. Points 20*a*, 20*c*, and 20*e* are points where the surface transitions from convex to concave and points 20*b* and 20*f* are points where the surface transitions from concave to convex.

While not be bound to any particular theory, the undulating surface may be created by differential shrinkage rates of the staple fibers within the first and second staple yarns, and elastomeric yarns. With the placement of anchor lines in the vertical and/or horizontal direction, the raised surfaces in between the anchor lines bulk and shrink in a random, independent fashion. Elastomeric yarns help create the raised area that allows the stuffer yarns to independently bulk within each raised area.

A Keyence VHX-6000 was used to obtain a three-dimensional image of the double-knit fabric. The image should represent an area at least 2.9 cm×3.5 cm on the double-knit fabric surface. The topography (aligned with the dominant symmetry directions of the material) of the upper surface 10*a* of the double-knit fabric 10 was generated using the profile line tool available with the Keyence VHX-6000. The profile generated was an average profile, where the range is set at 5 lines and the interval is set on 300 μm. This amounts to averaging the profiles of 11 lines (5 on either side of the center line), all separated by 300 mm, or 0.03 cm. This has the effect of averaging out the fluctuations in height due to individual yarn variations. The center line for this profile is oriented along the targeted direction and centered on the high points/center of the detached regions in the profile direction. For each image of a fabric specimen, there are often multiple rows and columns (at approx. Right angles to each other) of the repeated structure of detached regions. A profile is formed as described above for each distinct row and column.

The first knit layer 20 contains a plurality of first yarns and the second knit layer 30 contains a plurality of second yarns. The yarns that make up these layers can be any suitable yarn. "Yarn", in this application, as used herein includes a monofilament elongated body, a multifilament elongated body, ribbon, strip, yarn, tape, fiber and the like. The knit layers 20, 30 may contain one type of yarn or a plurality of any one or combination of the above. The yarns may be of any suitable form such as spun staple yarn, monofilament, or multifilament, single component, bi-component, or multi-component, and have any suitable cross-section shape such as circular, multi-lobal, square or rectangular (tape), and oval. Preferably, the first yarns and the second yarns consist of staple fibers, "consist of" being defined as at least 98% by weight.

The yarns of the knit layers 20, 30 may be formed of (but are not limited to) cellulosic yarns (such as cotton, rayon, linen, jute, hemp, cellulose acetate, and combinations, mixtures, or blends thereof), polyester yarns (e.g., poly(ethylene terephthalate) yarns, poly(propylene terephthalate) (PET) yarns, poly(trimethylene terephthalate) yarns), poly(butylene terephthalate) yarns, and blends thereof), polyamide yarns (e.g., nylon 6 yarns, nylon 6,6 yarns, nylon 4,6 yarns, and nylon 12 yarns), polyvinyl alcohol yarns, an elastic polyester-polyurethane copolymer (SPANDEX®), polypropylene yarns, polyethylene yards, polyvinyl acetate yarns, polylactic acid yarns, flame-resistant meta-aramid (NOMEX®) or para-aramid, and combinations, mixtures, or blends thereof. In one embodiment, the yarns that make up the knit layers 20, 30 all have approximately the same thickness or denier. In other embodiments, there is a difference in denier. In another embodiment, there may be more than one type of yarn within a knit layer (varying in materials, construction, and/or denier) or the yarns used may contain more than one type of fiber. In one embodiment, at least one of the first and second knit layers 20, 30 contains either nylon fibers or yarns.

In one embodiment, the first yarns in the first knit layer contain a plurality of first fire resistant (FR) inherent fibers and first non-FR fibers. The second yarns in the second knit layer contain a plurality of second fire resistant (FR) inherent fibers and second non-FR fibers. The first and second FR inherent fibers may be the same material or different material. The first and second non-FR fibers may be the same material or different material. Preferably, both the first and the second yarns contain between about 25 and 90% by weight FR inherent fibers, more preferably between about 45 and 60% by weight FR inherent fibers. In another embodiment, the both the first and the second yarns contain between about 50 and 85% by weight FR inherent fibers, more preferably between about 50 and 65% by weight. Preferably, both the first and the second yarns contain between about 10 and 75% by weight non-FR fibers, more preferably between about 40 and 55% by weight non-FR fibers. In another embodiment, the both the first and the second yarns contain between about 25 and 70% by weight non-FR fibers, more preferably between about 45 and 50% by weight non-FR fibers. In a preferred embodiment, the FR inherent fibers are a blend of modacrylic, meta-aramid, and para-aramid. In a preferred embodiment, the non-FR fibers are cellulosic, preferably lyocell. One preferred blend of both the first, second, and stuffer yarns is about 47% lyocell fibers, 38% modacrylic fibers, 10% meta-aramid fibers, and 5% para-aramid fibers (all % by weight).

In at least one of the warp and weft directions, there is preferably a plurality of elastic yarns. More preferably, there are elastic yarns in both the warp and weft direction. The elastic yarns are preferably included in the knitting process in a pattern, for example, 5 first yarns then one elastic yarn, then 5 first yarns then one elastic yarn. The repeating pattern of elastic and other (first or second) yarns can be any suitable value from 1:1 first/second to elastic to 1:20. The elastic yarns preferably contain elastic filaments and will stretch under normal wearing conditions. The elastic yarns contain an elastomer defined as being any rubbery material composed of long chainlike molecules, or polymers, that are capable of recovering their original shape after being stretched to great extents (such as polyisoprene, natural rubber, butadiene rubber, and others).

Referring back to FIG. 1, there are also fabric also contains a plurality of stuffer yarns 40 located between the first knit layer 20 and the second knit layer 30. These stuffer yarns may be any suitable yarn and are preferably bulky so that they fill up the areas between the first and second knit layers and provides insulation. In one embodiment, the stuffer yarns are a multifilament polyester yarn (continuous, not staple). It has been shown that polyester yarns may be easily bulked and retain their volume over time. In one preferred embodiment, the stuffer yarns are faux twist textured yarns. Preferably, the stuffer yarns run approximately parallel to each other in the weft direction of the double-knit fabric. In another preferred embodiment, the stuffer yarns contain staple yarns, more preferably consist of staple yarns (defined as at least 98% by weight staple fibers). The stuffer yarns have the same composition as the first and second yarns of about 47% lyocell fibers, 38% modacrylic fibers, 10% meta-aramid fibers, and 5% para-aramid fibers (all % by weight). Preferably, the stuffer yarns contain at least one type of FR fiber.

Thickness of both layers 20, 30 may be any suitable thickness and may be approximately equally distributed, or one of the layers may thicker than the other. Typical thickness of each layer of fabric is between about 0.1 and 6 mm, more preferably between about 1 and 4 mm.

The two knit layers 20 and 30 may be combined, knitted, and joined together (during knitting) in any suitable manner. A first method is interlacing first yarns from the first knit layer 20 among the second yarns of the second knit layer 30, meaning that a portion of the yarns from the first knit layer leave the first knit layer, travel down into the second knit layer where they are interlaced with yarns within the second knit layer, and then travel back up to the first knit layer.

A second method is interlacing second yarns from the second knit layer 30 among the yarns of the first knit layer 20, meaning that a portion of the yarns from the second knit layer 30 leave the second knit layer, travel up into the first knit layer where they are interlaced with yarns within the first knit layer, and then travel back down to the second knit layer to the first knit layer.

A third method is interlacing a plurality of additional yarns in among the yarns of the first knit layer 20 and the yarns of the second knit layer 30. This means that an additional yarn (which may be the same or different yarn than the yarns in the first or second knit layers) travels between the layers, interlacing with yarns from both layers and in essence, tying them together. This additional yarn may be selected from any of the yarns described in reference to the yarns in the first knit layer.

In a preferred embodiment, the second method is used to interlace and knit the first 20 and second 30 knit layers together. This method may be preferred because of the lower complexity during the knitting process using the circular knitting.

Preferably, the double-knit fabric has a clo value measured by test ASTM F1868 of at least about RCT 0.5. Clo is a measure of insulative value of the fabric. In another embodiment, the double-knit fabric has a clo value measured by test ASTM F1868 of at least about RCT 0.5, more preferably at least about RCT 0.6. In another embodiment, RCT 0.9. The double-knit fabric of claim 1, wherein the double-knit fabric has an air permeability of at least about 70 CFM, more preferably about 80 CFM, more preferably about 90 CFM, and more preferably about 100 CFM.

When the fabric 10 is made into an article of clothing (also referred to as a garment), in one embodiment the lower surface 10*b* would be facing away from the wearer and upper surface 10*a* would be facing towards the wearer. In another embodiment, the lower surface 10*b* would be facing the wearer and upper surface 10*a* would be facing away from the wearer. The double-knit fabric 10 is a unitary material that is formed together in a knitting machine with the two layers sometimes being separate and sometimes knitted together. The layers 20 and 30 are not formed as discrete knit layers and then joined together in a later operation. The fabric 10 may be made by any suitable knitting method, including both warp knitting and weft (or circular) knitting. Circular knitting is preferred in some embodiments, as it tends to be more cost efficient. The article of clothing may be any suitable article including but not limited to a shirt, jacket, pants, tights, leggings, hat, undergarments, and socks.

In another embodiment, a garment may use the fabric in addition to other fabric. For example, a shirt might use the fabric of the invention on the torso and another fabric in the sleeves. Additionally, the fabric of the invention could also be used as an insert. Additionally, the fabric may be used for any other suitable purpose including, but not limited to, a tent, automobile covering, upholstery, mattress covers, and pet beds.

Example 1

A double knit fabric was made using first yarns, second yarns, and stuffer yarns having the following weight percentages of fibers: 47% lyocell/38% modacrylic/10% meta-aramid/5% para-aramid (by weight fibers) The fabric also contained approximately 8.5% by weight elastic yarns. The two knit layers were connected by having a portion of the first yarns from the first knit layer travel and knit with the second yarns from the second knit layer. This knitting formed anchored lines and detached regions where the detached regions were rectangular (approximately square). The FR stuffer yarns were placed between the two knitted layers in the weft direction during the knitting of the fabric.

Figure 4:
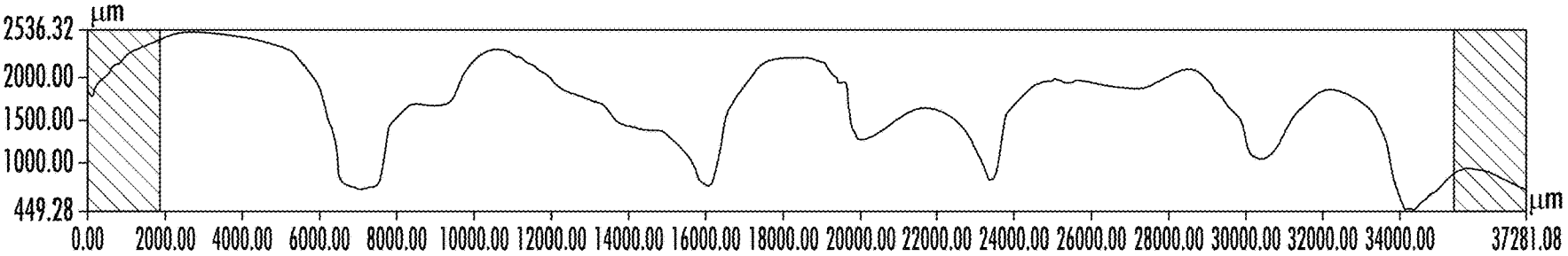
FIG. 4 is a topographic map of one line along the warp direction of the double-knit fabric according to one embodiment of the invention.
Figure 5:
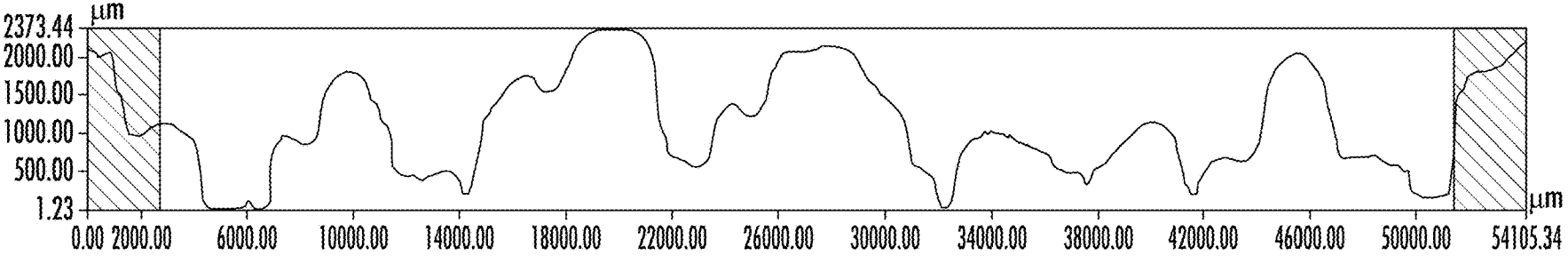
FIG. 5 is a topographic map of one line along the weft direction of the double-knit fabric according to one embodiment of the invention.

After finishing, the first knit layer contained an undulating surface. FIG. 4 is a topographic map of one line along the warp direction of the double-knit fabric of the example and FIG. 5 is a topographic map of one line along the weft direction of the double-knit fabric of the example. At least 90% by number of the detached regions contain at least 3 inflection points in the both the warp and weft directions. The finished fabric had an areal weight of about 10-16 oz/yd$^2$ (before and after washing) and had an ATPV of 34 cal/cm$^2$ (measured according to ASTM F1959).

Example 2

A double knit fabric was made using polyester multifilament first yarns and elastic yarns for the first knit layer forming the upper surface of the double knit fabric and polyester second yarns for the second knit layer. The two knit layers were connected by having a portion of the polyester yarns from the first knit layer travel and knit with the polyester yarns from the second knit layer. This knitting formed anchored lines and detached regions where the detached regions were rectangular (approximately square). Polyester stuffer yarns were placed between the two knitted layers in the weft direction. This fabric did not contain any FR inherent fibers/yarns.

After finishing, the first knit layer contained a bubble-like surface. Less than 25% by number of the detached regions contain at least 3 inflection points in the warp and weft directions.

The fabric of example 1 showed some improved characteristics for some applications as compared to example 2. The fabric of example 1 passed the ASTM 6413 vertical burn test with no melt/no drip and had an increased Clo value normalized to the fabric weight compared to example 2.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the subject matter of this application (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the subject matter of the application and does not pose a limitation on the scope of the subject matter unless otherwise claimed. No language in the specification should be construed as indicating any non-claimed element as essential to the practice of the subject matter described herein. The term "about" in this application, is defined to mean the number given plus and minus 10%. For example, a value of about 10 g is given in the specification, this is defined to mean 9.9 to 1.1 g.

Preferred embodiments of the subject matter of this application are described herein, including the best mode known to the inventors for carrying out the claimed subject matter. Variations of those preferred embodiments may become apparent to those of ordinary skill in the art upon reading the foregoing description. The inventors expect skilled artisans to employ such variations as appropriate, and the inventors intend for the subject matter described herein to be practiced otherwise than as specifically described herein. Accordingly, this disclosure includes all modifications and equivalents of the subject matter recited in the claims appended hereto as permitted by applicable law. Moreover, any combination of the above-described elements in all possible variations thereof is encompassed by the present disclosure unless otherwise indicated herein or otherwise clearly contradicted by context.

What is claimed is:

1. A double-knit fabric having an upper surface and a lower surface and having a warp and weft direction, wherein the weft direction is perpendicular to the warp direction, wherein the double-knit fabric comprises:

a first knit layer comprising a plurality of first yarns and a plurality of first elastic yarns, wherein the first knit layer forms the upper surface of the double-knit fabric, wherein the first yarns comprise a plurality of first staple fibers;

a second knit layer comprising a plurality of second yarns, wherein the second knit layer forms the lower surface of the double-knit fabric, wherein the second yarns comprise a plurality of second staple fibers; and, a plurality of stuffer yarns, wherein the stuffer yarns are located between the first knit layer and the second knit layer;

wherein the double-knit fabric comprises a plurality of anchored lines and a plurality of detached regions, wherein the plurality of detached regions are bounded by the anchored lines, wherein in the anchored lines the first yarns from the first fabric layer and the second yarns from the second fabric layer are knitted together, and wherein in the detached regions the first fabric layer and second fabric layer are unattached;

wherein the first knit layer and the second knit layer are integrated within the anchored lines at least one method selected from the group consisting of interlacing first yarns of the first knit layer among the second yarns of the second knit layer, interlacing the second yarns of the second layer among the first yarns of the first knit layer, and interlacing a plurality of third yarns among the first yarns of the first knit layer and the second yarns of the second knit layer;

wherein the plurality of anchored lines are in at least one of the warp or weft directions, wherein the double-knit fabric the first knit layer has an undulating surface in at least 90% by number of the detached regions defined as the upper surface containing at least 3 inflection points in the warp or weft directions, wherein an inflection point is the point at which the surface switches from either concave to convex or convex to concave.

2. The double-knit fabric of claim 1, wherein first staple fibers comprise first fire resistant fibers.

3. The double-knit fabric of claim 2, wherein first staple fibers further comprise first non-fire resistant fibers.

4. The double-knit fabric of claim 1, wherein second staple fibers comprise second fire resistant fibers.

5. The double-knit fabric of claim 1, wherein the stuffer yarns comprise a plurality of stuffer fire resistant fibers and stuffer non-fire resistant fibers.

6. The double-knit fabric of claim 1, wherein the plurality of anchored lines are in the warp and weft directions and the anchored lines in the warp direction cross over the anchored lines in the weft direction.

7. The double-knit fabric of claim 1, wherein the average peak distance between the first fabric layer and the second fabric layer in the detached regions is at least about 3 mm.

8. The double-knit fabric of claim 1, wherein the double-knit fabric the first knit layer has an undulating surface in at least 90% by number of the detached regions defined as the upper surface containing at least 3 inflection points in the warp and weft directions.

9. The double-knit fabric of claim 1, wherein the double-knit fabric the first knit layer has an undulating surface in at least 30% by number of the detached regions defined as the upper surface containing at least 4 inflection points.

10. The double-knit fabric of claim 1, wherein the double-knit fabric has between about 2 and 5 detached regions per square inch.

11. The double-knit fabric of claim 1, wherein the double-knit fabric has a clo value measured by test ASTM F1868 is at least about RCT 0.5.

12. The double-knit fabric of claim 1, wherein the anchored lines are straight lines.

13. The double-knit fabric of claim 1, wherein the anchored lines in the warp directions are all parallel and have an average distance between them of between about 0.125 and 0.375 inch.

14. The double-knit fabric of claim 1, wherein the detached areas have at least one dimension within the plane of the double-knit knit of at least about 3 mm.

15. The double-knit fabric of claim 1, wherein the stuffer yarns run generally parallel to each other.

16. The double-knit fabric of claim 1, wherein the first layer and the second layer are integrated through combined portions formed by interlacing first yarns of the first knit layer among the second yarns of the second knit layer.

17. The double-knit fabric of claim 1, wherein the detached regions have a repeating grid pattern.

18. The double-knit fabric of claim 1, wherein at least a portion of the first yarns and second yarns are fire resistant yarns.

19. A garment comprising the double-knit fabric of claim 1.

20. The garment of claim 19, wherein the garment is selected from the group consisting of a jacket, pants, hat, and shirts.

* * * * *